US007451886B2

(12) United States Patent
Lisch et al.

(10) Patent No.: US 7,451,886 B2
(45) Date of Patent: Nov. 18, 2008

(54) CONTAINER BASE STRUCTURE RESPONSIVE TO VACUUM RELATED FORCES

(75) Inventors: G. David Lisch, Jackson, MI (US); Kerry W. Silvers, Campbellsburg, IN (US); Dwayne G. Vailliencourt, Manchester, MI (US); Brian L. Pieszchala, Ann Arbor, MI (US); Richard J. Steih, Jackson, MI (US)

(73) Assignee: Amcor Limited, Abbotsford, Victoria (AU)

( * ) Notice: Subject to any disclaimer, the term of this patent is extended or adjusted under 35 U.S.C. 154(b) by 487 days.

(21) Appl. No.: 11/151,676

(22) Filed: Jun. 14, 2005
(Under 37 CFR 1.47)

(65) Prior Publication Data

US 2006/0006133 A1 Jan. 12, 2006

Related U.S. Application Data

(63) Continuation-in-part of application No. 11/116,764, filed on Apr. 28, 2005, now Pat. No. 7,150,372, which is a continuation of application No. 10/445,104, filed on May 23, 2003, now Pat. No. 6,942,116.

(51) Int. Cl.
*B65D 1/02* (2006.01)
*B65D 1/40* (2006.01)

(52) U.S. Cl. ..... 215/373; 215/371; 220/606; 220/609

(58) Field of Classification Search ..... 215/371, 215/373–375; 220/606, 608, 609
See application file for complete search history.

(56) References Cited

U.S. PATENT DOCUMENTS

| | | | | |
|---|---|---|---|---|
| 3,409,167 | A | 11/1968 | Blanchard | |
| 3,942,673 | A | 3/1976 | Lyu et al. | |
| 4,125,632 | A | 11/1978 | Vosti et al. | |
| 4,174,782 | A | 11/1979 | Obsomer | |
| 4,231,483 | A | 11/1980 | Dechenne et al. | |
| 4,342,398 | A | 8/1982 | Chang | |
| 4,381,061 | A | 4/1983 | Cerny et al. | |
| 4,408,698 | A | 10/1983 | Ballester | |
| 4,431,112 | A | 2/1984 | Yamaguchi | |
| 4,542,029 | A * | 9/1985 | Caner et al. | 426/127 |
| 4,620,639 | A | 11/1986 | Yoshino | |
| 4,667,454 | A | 5/1987 | McHenry et al. | |
| 4,880,129 | A | 11/1989 | McHenry et al. | |
| 5,005,716 | A | 4/1991 | Eberle | |
| 5,217,737 | A | 6/1993 | Gygax et al. | |
| 5,234,126 | A | 8/1993 | Jonas et al. | |
| 5,492,245 | A | 2/1996 | Kalkanis | |
| RE36,639 | E | 4/2000 | Okhai | |
| 6,176,382 | B1 | 1/2001 | Rashid | |
| 6,299,007 | B1 | 10/2001 | Takeuchi | |

(Continued)

*Primary Examiner*—Sue A Weaver
(74) *Attorney, Agent, or Firm*—Harness, Dickey & Pierce, P.L.C.

(57) ABSTRACT

A plastic container having a base portion adapted for vacuum pressure absorption. The base portion including a contact ring that supports the container, an upstanding wall, and a central portion. The upstanding wall being adjacent to and generally circumscribing the contact ring. The central portion defined in at least part by a pushup and an inversion ring that generally circumscribes the pushup. The pushup having a generally truncated cone shape in cross section and the inversion ring having a generally S shaped geometry in cross section. The pushup and the inversion ring being moveable to accommodate vacuum related forces generated within the container.

20 Claims, 9 Drawing Sheets

U.S. PATENT DOCUMENTS 6,595,380 B2 7/2003 Silvers
6,612,451 B2 9/2003 Tobias et al.
6,857,531 B2 2/2005 Slat et al.
6,942,116 B2 * 9/2005 Lisch et al. ..... 215/373
7,150,372 B2 * 12/2006 Lisch et al. ..... 215/373
2004/0211746 A1 10/2004 Trude

* cited by examiner

CONTAINER BASE STRUCTURE RESPONSIVE TO VACUUM RELATED FORCES

This application is a continuation-in-part of U.S. patent application Ser. No. 11/116,764, filed Apr. 28, 2005 U.S. Pat. No. 7,150,372; which is a continuation of U.S. patent application Ser. No. 10/445,104, filed May 23, 2003 U.S. Pat. No. 6,942,116 and commonly assigned.

TECHNICAL FIELD OF THE INVENTION

This invention generally relates to plastic containers for retaining a commodity, and in particular a liquid commodity. More specifically, this invention relates to a panel-less plastic container having a base structure that allows for significant absorption of vacuum pressures by the base without unwanted deformation in other portions of the container.

BACKGROUND OF THE INVENTION

As a result of environmental and other concerns, plastic containers, more specifically polyester and even more specifically polyethylene terephthalate (PET) containers are now being used more than ever to package numerous commodities previously supplied in glass containers. Manufacturers and fillers, as well as consumers, have recognized that PET containers are lightweight, inexpensive, recyclable and manufacturable in large quantities.

Manufacturers currently supply PET containers for various liquid commodities, such as juice and isotonic beverages. Suppliers often fill these liquid products into the containers while the liquid product is at an elevated temperature, typically between 155° F.-205° F. (68° C.-96° C.) and usually at approximately 185° F. (85° C.). When packaged in this manner, the hot temperature of the liquid commodity sterilizes the container at the time of filling. The bottling industry refers to this process as hot filling, and the containers designed to withstand the process as hot-fill or heat-set containers.

The hot filling process is acceptable for commodities having a high acid content, but not generally acceptable for non-high acid content commodities. Nonetheless, manufacturers and fillers of non-high acid content commodities desire to supply their commodities in PET containers as well.

For non-high acid commodities, pasteurization and retort are the preferred sterilization process. Pasteurization and retort both present an enormous challenge for manufactures of PET containers in that heat-set containers cannot withstand the temperature and time demands required of pasteurization and retort.

Pasteurization and retort are both processes for cooking or sterilizing the contents of a container after filling. Both processes include the heating of the contents of the container to a specified temperature, usually above approximately 155° F. (approximately 70° C.), for a specified length of time (20-60 minutes). Retort differs from pasteurization in that retort uses higher temperatures to sterilize the container and cook its contents. Retort also applies elevated air pressure externally to the container to counteract pressure inside the container. The pressure applied externally to the container is necessary because a hot water bath is often used and the overpressure keeps the water, as well as the liquid in the contents of the container, in liquid form, above their respective boiling point temperatures.

PET is a crystallizable polymer, meaning that it is available in an amorphous form or a semi-crystalline form. The ability of a PET container to maintain its material integrity relates to the percentage of the PET container in crystalline form, also known as the "crystallinity" of the PET container. The following equation defines the percentage of crystallinity as a volume fraction:

$$\%\ \text{Crystallinity} = \left(\frac{\rho - \rho_a}{\rho_c - \rho_a}\right) \times 100$$

where ρ is the density of the PET material; $\rho_a$ is the density of pure amorphous PET material (1.333 g/cc); and $\rho_c$ is the density of pure crystalline material (1.455 g/cc).

Container manufacturers use mechanical processing and thermal processing to increase the PET polymer crystallinity of a container. Mechanical processing involves orienting the amorphous material to achieve strain hardening. This processing commonly involves stretching a PET preform along a longitudinal axis and expanding the PET preform along a transverse or radial axis to form a PET container. The combination promotes what manufacturers define as biaxial orientation of the molecular structure in the container. Manufacturers of PET containers currently use mechanical processing to produce PET containers having approximately 20% crystallinity in the container's sidewall.

Thermal processing involves heating the material (either amorphous or semi-crystalline) to promote crystal growth. On amorphous material, thermal processing of PET material results in a spherulitic morphology that interferes with the transmission of light. In other words, the resulting crystalline material is opaque, and thus, generally undesirable. Used after mechanical processing, however, thermal processing results in higher crystallinity and excellent clarity for those portions of the container having biaxial molecular orientation. The thermal processing of an oriented PET container, which is known as heat setting, typically includes blow molding a PET preform against a mold heated to a temperature of approximately 250° F.-350° F. (approximately 121° C.-177° C.), and holding the blown container against the heated mold for approximately two (2) to five (5) seconds. Manufacturers of PET juice bottles, which must be hot-filled at approximately 185° F. (85° C.), currently use heat setting to produce PET bottles having an overall crystallinity in the range of approximately 25-35%.

After being hot-filled, the heat-set containers are capped and allowed to reside at generally the filling temperature for approximately five (5) minutes at which point the container, along with the product, is then actively cooled prior to transferring to labeling, packaging, and shipping operations. The cooling reduces the volume of the liquid in the container. This product shrinkage phenomenon results in the creation of a vacuum within the container. Generally, vacuum pressures within the container range from 1-380 mm Hg less than atmospheric pressure (i.e., 759 mm Hg-380 mm Hg). If not controlled or otherwise accommodated, these vacuum pressures result in deformation of the container, which leads to either an aesthetically unacceptable container or one that is unstable. Typically, the industry accommodates vacuum related pressures with sidewall structures or vacuum panels. Vacuum panels generally distort inwardly under the vacuum pressures in a controlled manner to eliminate undesirable deformation in the sidewall of the container.

While vacuum panels allow containers to withstand the rigors of a hot-fill procedure, the panels have limitations and drawbacks. First, vacuum panels do not create a generally smooth glass-like appearance. Second, packagers often apply a wrap-around or sleeve label to the container over the vacuum panels. The appearance of these labels over the sidewall and vacuum panels is such that the label often becomes wrinkled and not smooth. Additionally, one grasping the container generally feels the vacuum panels beneath the label and often pushes the label into various panel crevasses and recesses.

Further refinements have led to the use of pinch grip geometry in the sidewall of the containers to help control container distortion resulting from vacuum pressures. However, similar limitations and drawbacks exist with pinch grip geometry as with vacuum panels.

Another way for a hot-fill plastic container to achieve the above described objectives without having vacuum accommodating structural features is through the use of nitrogen dosing technology. One drawback with this technology however is that the maximum line speeds achievable with the current technology is limited to roughly 200 containers per minute. Such slower line speeds are seldom acceptable. Additionally, the dosing consistency is not yet at a technological level to achieve efficient operations.

Thus, there is a need for an improved container which can accommodate the vacuum pressures which result from hot filling yet which mimics the appearance of a glass container having sidewalls without substantial geometry, allowing for a smooth, glass-like appearance. It is therefore an object of this invention to provide such a container.

SUMMARY OF THE INVENTION

Accordingly, this invention provides for a plastic container which maintains aesthetic and mechanical integrity during any subsequent handling after being hot-filled and cooled to ambient having a base structure that allows for significant absorption of vacuum pressures by the base without unwanted deformation in other portions of the container. In a glass container, the container does not move, its structure must restrain all pressures and forces. In a bag container, the container easily moves and conforms to the product. The present invention is somewhat of a highbred, providing areas that move and areas that do not move. Ultimately, after the base portion of the plastic container of the present invention moves or deforms, the remaining overall structure of the container restrains all anticipated additional pressures or forces without collapse.

The present invention includes a plastic container having an upper portion, a body or sidewall portion, and a base. The upper portion includes an opening defining a mouth of the container. The body portion extends from the upper portion to the base. The base includes a central portion defined in at least part by a pushup and an inversion ring. The pushup having a generally truncated cone shape in cross section and the inversion ring having a generally S shaped geometry in cross section.

Additional benefits and advantages of the present invention will become apparent to those skilled in the art to which the present invention relates from the subsequent description of the preferred embodiments and the appended claims, taken in conjunction with the accompanying drawings.

DETAILED DESCRIPTION OF THE PREFERRED EMBODIMENTS

The following description of the preferred embodiments is merely exemplary in nature, and is in no way intended to limit the invention or its application or uses.

As discussed above, to accommodate vacuum related forces during cooling of the contents within a PET heat-set container, containers typically have a series of vacuum panels or pinch grips around their sidewall. The vacuum panels and pinch grips deform inwardly under the influence of vacuum related forces and prevent unwanted distortion elsewhere in the container. However, with vacuum panels and pinch grips, the container sidewall cannot be smooth or glass-like, an overlying label often becomes wrinkled and not smooth, and end users can feel the vacuum panels and pinch grips beneath the label when grasping and picking up the container.

In a vacuum panel-less container, a combination of controlled deformation (i.e., in the base or closure) and vacuum resistance in the remainder of the container is required. Accordingly, this invention provides for a plastic container which enables its base portion under typical hot-fill process conditions to deform and move easily while maintaining a rigid structure (i.e., against internal vacuum) in the remainder of the container. As an example, in a 16 fl. oz. plastic container, the container typically should accommodate roughly 20-24 cc of volume displacement. In the present plastic container, the base portion accommodates a majority of this requirement (i.e., roughly 13 cc). The remaining portions of the plastic container are easily able to accommodate the rest of this volume displacement without readily noticeable distortion.

Figure 1:
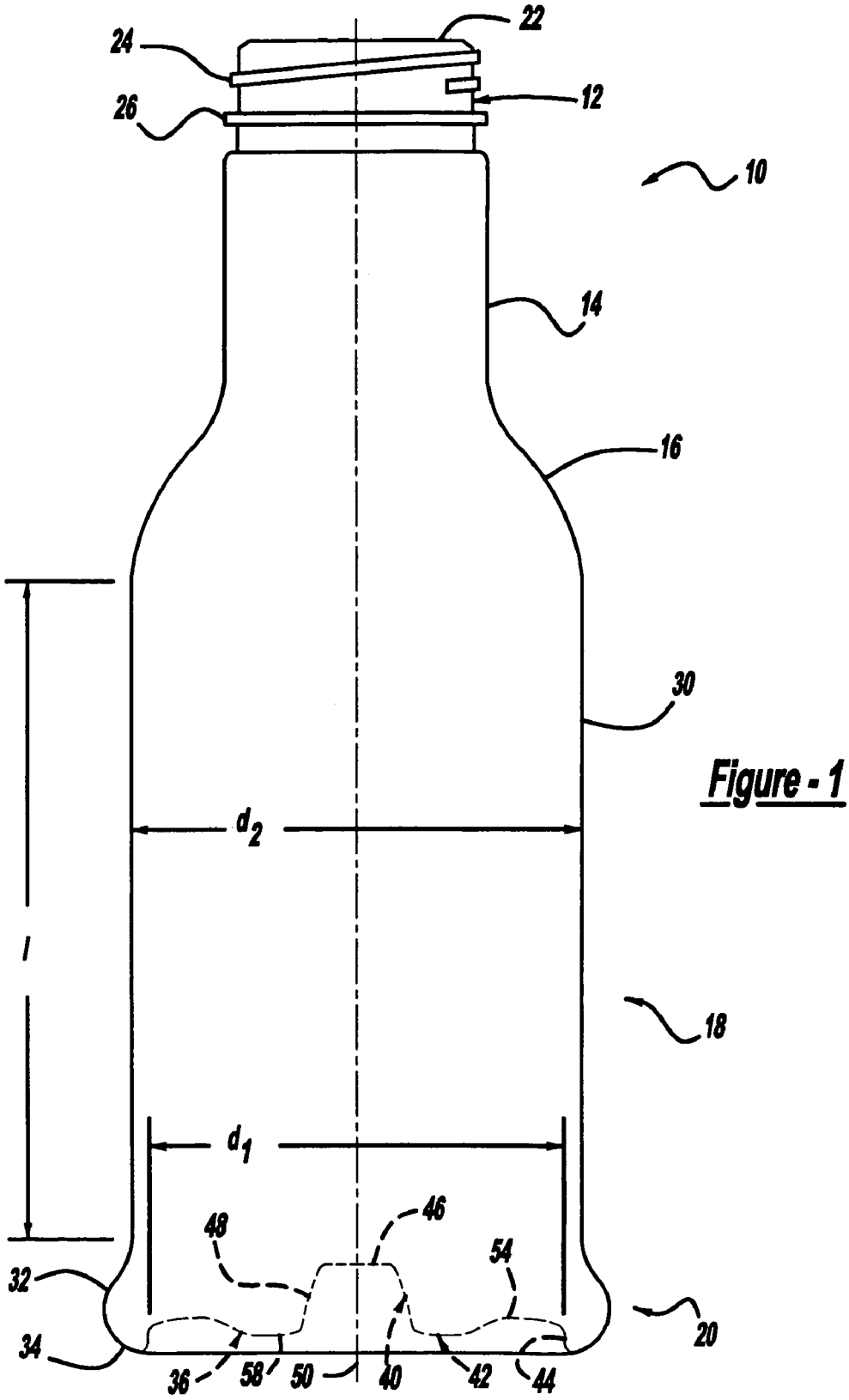
FIG. 1 is an elevational view of a plastic container according to the present invention, the container as molded and empty.
Figure 2:
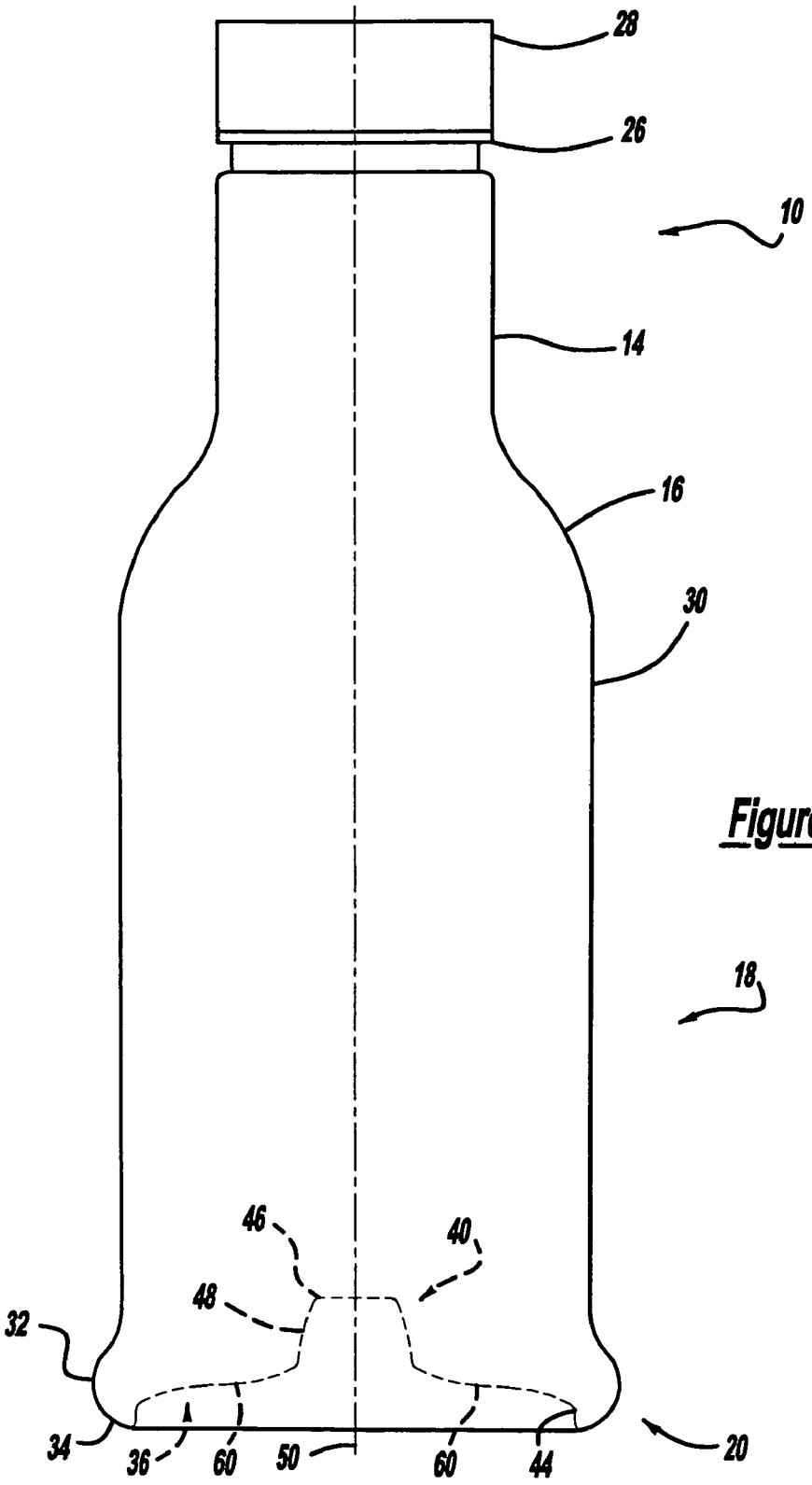
FIG. 2 is an elevational view of the plastic container according to the present invention, the container being filled and sealed.
Figure 3:
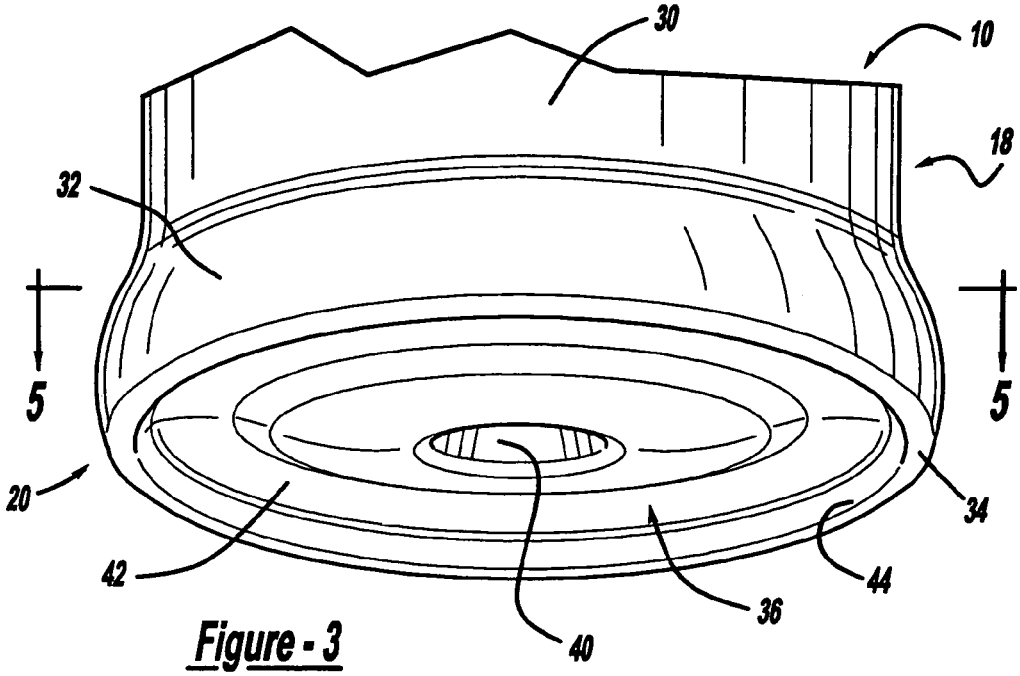
FIG. 3 is a bottom perspective view of a portion of the plastic container of FIG. 1.
Figure 4:
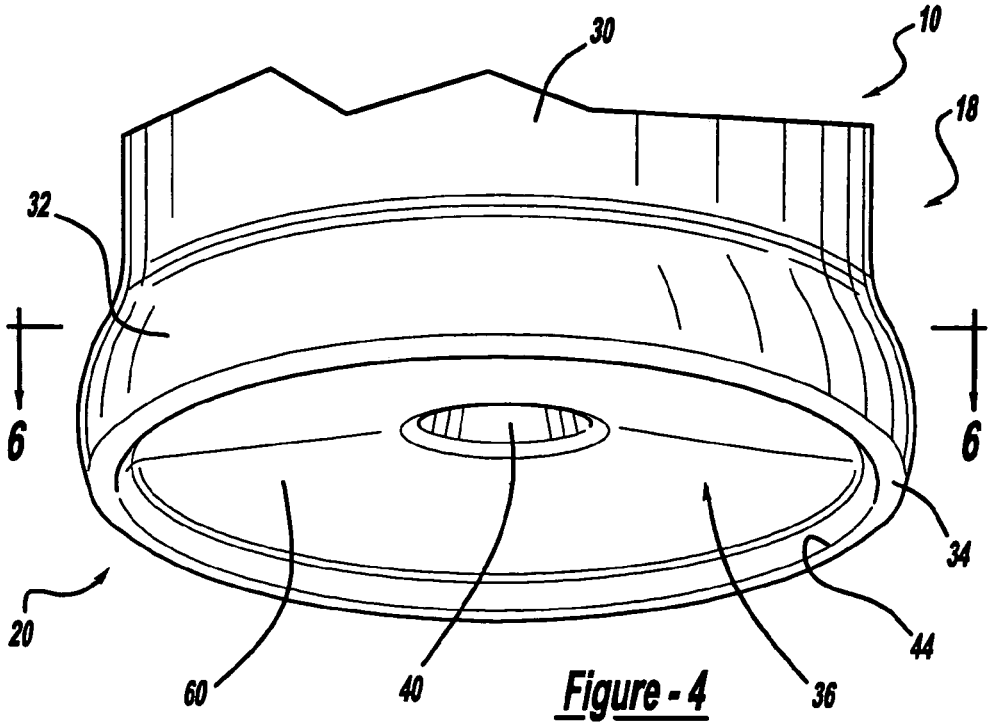
FIG. 4 is a bottom perspective view of a portion of the plastic container of FIG. 2.

As shown in FIGS. 1 and 2, a plastic container 10 of the invention includes a finish 12, a neck or an elongated neck 14, a shoulder region 16, a body portion 18, and a base 20. Those skilled in the art know and understand that the neck 14 can have an extremely short height, that is, becoming a short extension from the finish 12, or an elongated neck as illustrated in the figures, extending between the finish 12 and the shoulder region 16. The plastic container 10 has been designed to retain a commodity during a thermal process, typically a hot-fill process. For hot-fill bottling applications, bottlers generally fill the container 10 with a liquid or product at an elevated temperature between approximately 155° F. to 205° F. (approximately 68° C. to 96° C.) and seal the container 10 with a closure 28 before cooling. As the sealed container 10 cools, a slight vacuum, or negative pressure, forms inside causing the container 10, in particular, the base 20 to change shape. In addition, the plastic container 10 may be suitable for other high-temperature pasteurization or retort filling processes, or other thermal processes as well.

The plastic container 10 of the present invention is a blow molded, biaxially oriented container with an unitary construction from a single or multi-layer material. A well-known stretch-molding, heat-setting process for making the hot-fillable plastic container 10 generally involves the manufacture of a preform (not illustrated) of a polyester material, such as polyethylene terephthalate (PET), having a shape well known to those skilled in the art similar to a test-tube with a generally cylindrical cross section and a length typically approximately fifty percent (50%) that of the container height. A machine (not illustrated) places the preform heated to a temperature between approximately 190° F. to 250° F. (approximately 88° C. to 121° C.) into a mold cavity (not illustrated) having a shape similar to the plastic container 10. The mold cavity is heated to a temperature between approximately 250° F. to 350° F. (approximately 121° C. to 177° C.). A stretch rod apparatus (not illustrated) stretches or extends the heated preform within the mold cavity to a length approximately that of the container thereby molecularly orienting the polyester material in an axial direction generally corresponding with a central longitudinal axis 50. While the stretch rod extends the preform, air having a pressure between 300 PSI to 600 PSI (2.07 MPa to 4.14 MPa) assists in extending the preform in the axial direction and in expanding the preform in a circumferential or hoop direction thereby substantially conforming the polyester material to the shape of the mold cavity and further molecularly orienting the polyester material in a direction generally perpendicular to the axial direction, thus establishing the biaxial molecular orientation of the polyester material in most of the container. Typically, material within the finish 12 and a sub-portion of the base 20 are not substantially molecularly oriented. The pressurized air holds the mostly biaxial molecularly oriented polyester material against the mold cavity for a period of approximately two (2) to five (5) seconds before removal of the container from the mold cavity. To achieve appropriate material distribution within the base 20, the inventors employ an additional stretch-molding step substantially as taught by U.S. Pat. No. 6,277,321 which is incorporated herein by reference.

Alternatively, other manufacturing methods using other conventional materials including, for example, polyethylene naphthalate (PEN), a PET/PEN blend or copolymer, and various multilayer structures may be suitable for the manufacture of plastic container 10. Those having ordinary skill in the art will readily know and understand plastic container 10 manufacturing method alternatives.

The finish 12 of the plastic container 10 includes a portion defining an aperture or mouth 22, a threaded region 24, and a support ring 26. The aperture 22 allows the plastic container 10 to receive a commodity while the threaded region 24 provides a means for attachment of the similarly threaded closure or cap 28 (shown in FIG. 2). Alternatives may include other suitable devices that engage the finish 12 of the plastic container 10. Accordingly, the closure or cap 28 engages the finish 12 to preferably provide a hermetical seal of the plastic container 10. The closure or cap 28 is preferably of a plastic or metal material conventional to the closure industry and suitable for subsequent thermal processing, including high temperature pasteurization and retort. The support ring 26 may be used to carry or orient the preform (the precursor to the plastic container 10) (not shown) through and at various stages of manufacture. For example, the preform may be carried by the support ring 26, the support ring 26 may be used to aid in positioning the preform in the mold, or an end consumer may use the support ring 26 to carry the plastic container 10 once manufactured.

The elongated neck 14 of the plastic container 10 in part enables the plastic container 10 to accommodate volume requirements. Integrally formed with the elongated neck 14 and extending downward therefrom is the shoulder region 16. The shoulder region 16 merges into and provides a transition between the elongated neck 14 and the body portion 18. The body portion 18 extends downward from the shoulder region 16 to the base 20 and includes sidewalls 30. The specific construction of the base 20 of the container 10 allows the sidewalls 30 for the heat-set container 10 to not necessarily require additional vacuum panels or pinch grips and therefore, can be generally smooth and glass-like. However, a significantly lightweight container will likely include sidewalls having vacuum panels, ribbing, and/or pinch grips along with the base 20.

The base 20 of the plastic container 10, which extends inward from the body portion 18, generally includes a chime 32, a contact ring 34 and a central portion 36. As illustrated in FIGS. 5, 6, 7, 8, 10, and 12, the contact ring 34 is itself that portion of the base 20 that contacts a support surface 38 that in turn supports the container 10. As such, the contact ring 34 may be a flat surface or a line of contact generally circumscribing, continuously or intermittently, the base 20. The base 20 functions to close off the bottom portion of the plastic container 10 and, together with the elongated neck 14, the shoulder region 16, and the body portion 18, to retain the commodity.

The plastic container 10 is preferably heat-set according to the above-mentioned process or other conventional heat-set processes. To accommodate vacuum forces while allowing for the omission of vacuum panels and pinch grips in the body portion 18 of the container 10, the base 20 of the present invention adopts a novel and innovative construction. Generally, the central portion 36 of the base 20 has a central pushup 40 and an inversion ring 42. The inversion ring 42 includes an upper portion 54 and a lower portion 58. When viewed in cross section (see FIGS. 5, 7, and 10), the inversion ring 42 is generally "S" shaped. Additionally, the base 20 includes an upstanding circumferential wall or edge 44 that forms a transition between the inversion ring 42 and the contact ring 34.

As shown in FIGS. 1-8, 10, and 12, the central pushup 40, when viewed in cross section, is generally in the shape of a truncated cone having a top surface 46 that is generally parallel to the support surface 38. Side surfaces 48, which are generally planar in cross section, slope upward toward the central longitudinal axis 50 of the container 10. The exact shape of the central pushup 40 can vary greatly depending on various design criteria. However, in general, the overall diameter of the central pushup 40 (that is, the truncated cone) is at most 30% of generally the overall diameter of the base 20. The central pushup 40 is generally where the preform gate is captured in the mold. Located within the top surface 46 is the sub-portion of the base 20 which includes polymer material that is not substantially molecularly oriented.

As shown in FIGS. 3, 5, 7, and 10, when initially formed, the inversion ring 42, having a gradual radius, completely surrounds and circumscribes the central pushup 40. As formed, the inversion ring 42 protrudes outwardly, below a plane where the base 20 would lie if it was flat. The transition between the central pushup 40 and the adjacent inversion ring 42 must be rapid in order to promote as much orientation as near the central pushup 40 as possible. This serves primarily to ensure a minimal wall thickness 66 for the inversion ring 42, in particular the lower portion 58, of the base 20. Typically, the wall thickness 66 of the lower portion 58 of the inversion ring 42 is between approximately 0.008 inch (0.20 mm) to approximately 0.025 inch (0.64 mm), and preferably between approximately 0.010 inch to approximately 0.014 inch (0.25 mm to 0.36 mm) for a container having, for example, an approximately 2.64-inch (67.06 mm) diameter base. Wall thickness 70 of top surface 46, depending on precisely where one takes a measurement, can be 0.060 inch (1.52 mm) or more; however, wall thickness 70 of the top surface 46 quickly transitions to wall thickness 66 of the lower portion 58 of the inversion ring 42. The wall thickness 66 of the inversion ring 42 must be relatively consistent and thin enough to allow the inversion ring 42 to be flexible and function properly. At a point along its circumventional shape, the inversion ring 42 may alternatively feature a small indentation, not illustrated but well known in the art, suitable for receiving a pawl that facilitates container rotation about the central longitudinal axis 50 during a labeling operation.

The circumferential wall or edge 44, defining the transition between the contact ring 34 and the inversion ring 42 is, in cross section, an upstanding substantially straight wall approximately 0.030 inch (0.76 mm) to approximately 0.325 inch (8.26 mm) in length. Preferably, for a 2.64-inch (67.06 mm) diameter base container, the circumferential wall 44 measures between approximately 0.140 inch to approximately 0.145 inch (3.56 mm to 3.68 mm) in length. For a 5-inch (127 mm) diameter base container, the circumferential wall 44 could be as large as 0.325 inch (8.26 mm) in length. The circumferential wall or edge 44 is generally at an angle 64 relative to the central longitudinal axis 50 of between approximately zero degree and approximately 20 degrees, and preferably approximately 15 degrees. Accordingly, the circumferential wall or edge 44 need not be exactly parallel to the central longitudinal axis 50. The circumferential wall or edge 44 is a distinctly identifiable structure between the contact ring 34 and the inversion ring 42. The circumferential wall or edge 44 provides strength to the transition between the contact ring 34 and the inversion ring 42. This transition must be abrupt in order to maximize the local strength as well as to form a geometrically rigid structure. The resulting localized strength increases the resistance to creasing in the base 20. The contact ring 34, for a 2.64-inch (67.06 mm) diameter base container, generally has a wall thickness 68 of approximately 0.010 inch to approximately 0.016 inch (0.25 mm to 0.41 mm). Preferably, the wall thickness 68 is at least equal to, and more preferably is approximately ten percent, or more, than that of the wall thickness 66 of the lower portion 58 of the inversion ring 42.

Figure 5:
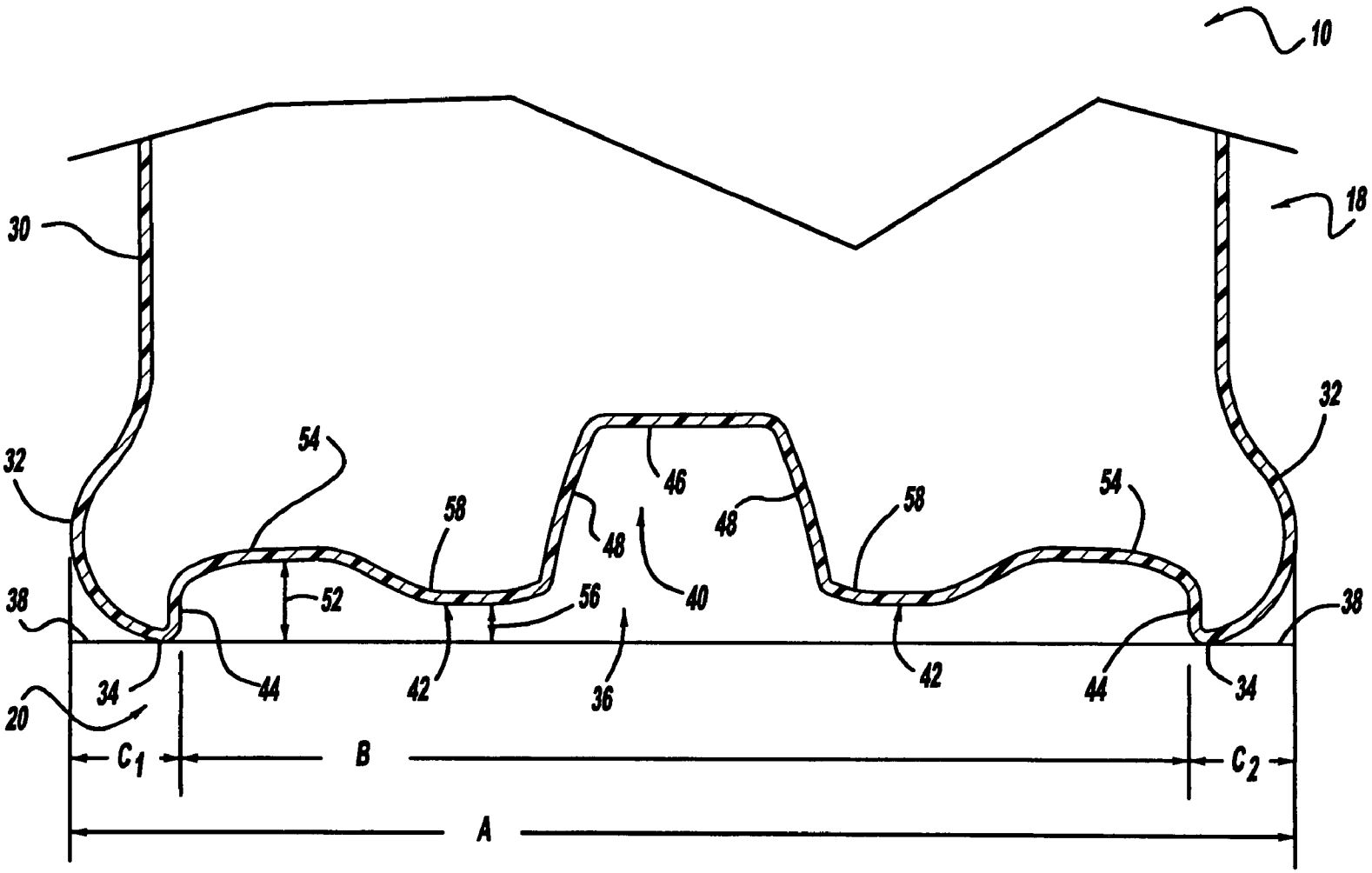
FIG. 5 is a cross-sectional view of the plastic container, taken generally along line 5-5 of FIG. 3.
Figure 6:
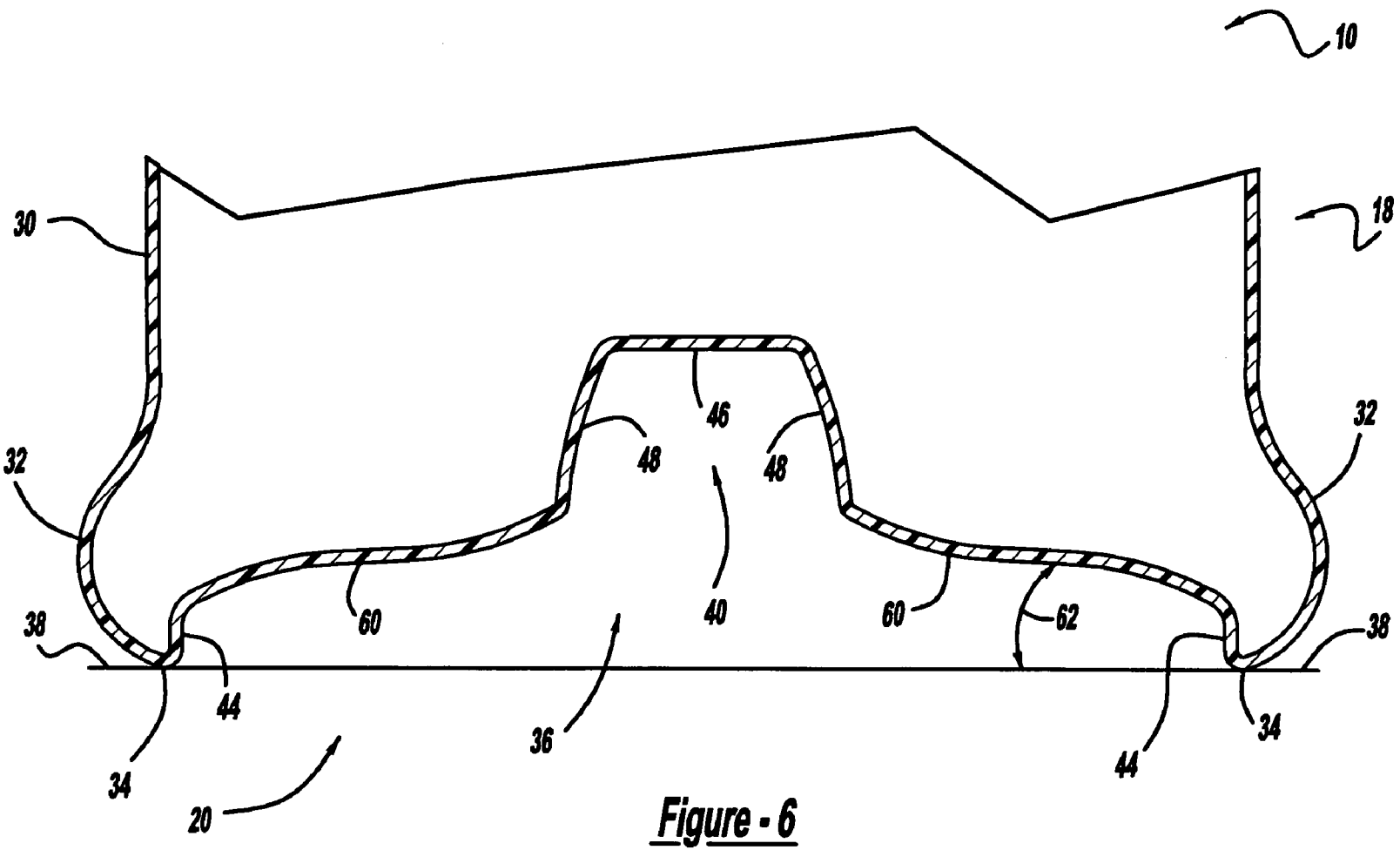
FIG. 6 is a cross-sectional view of the plastic container, taken generally along line 6-6 of FIG. 4.
Figure 7:
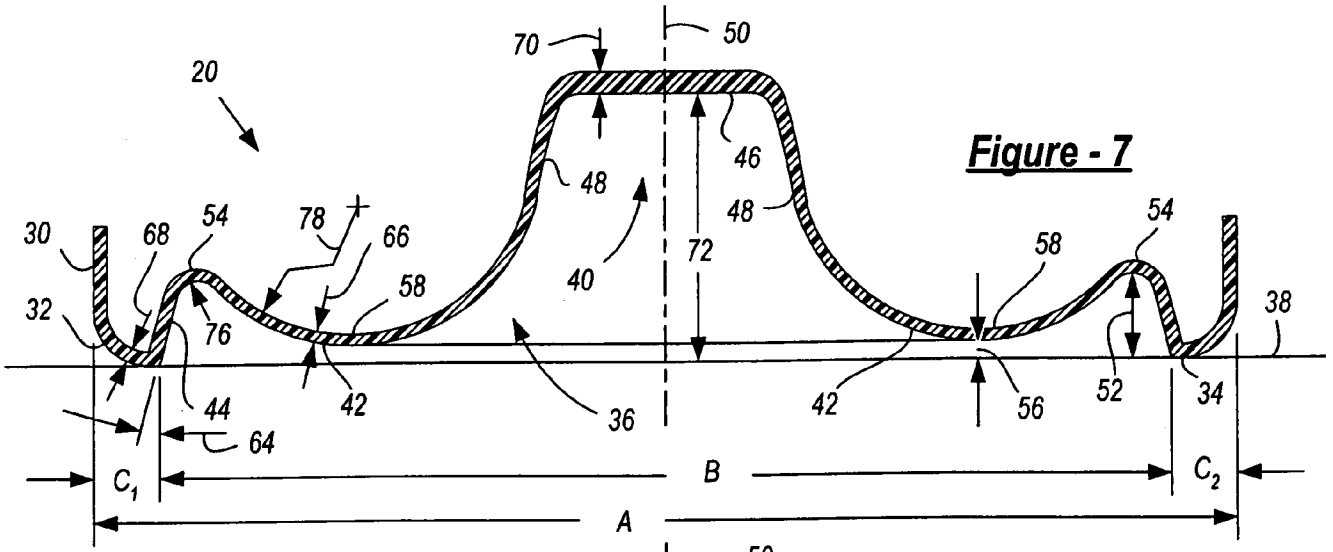
FIG. 7 is a cross-sectional view of the plastic container, similar to FIG. 5, showing another embodiment.
Figure 8:
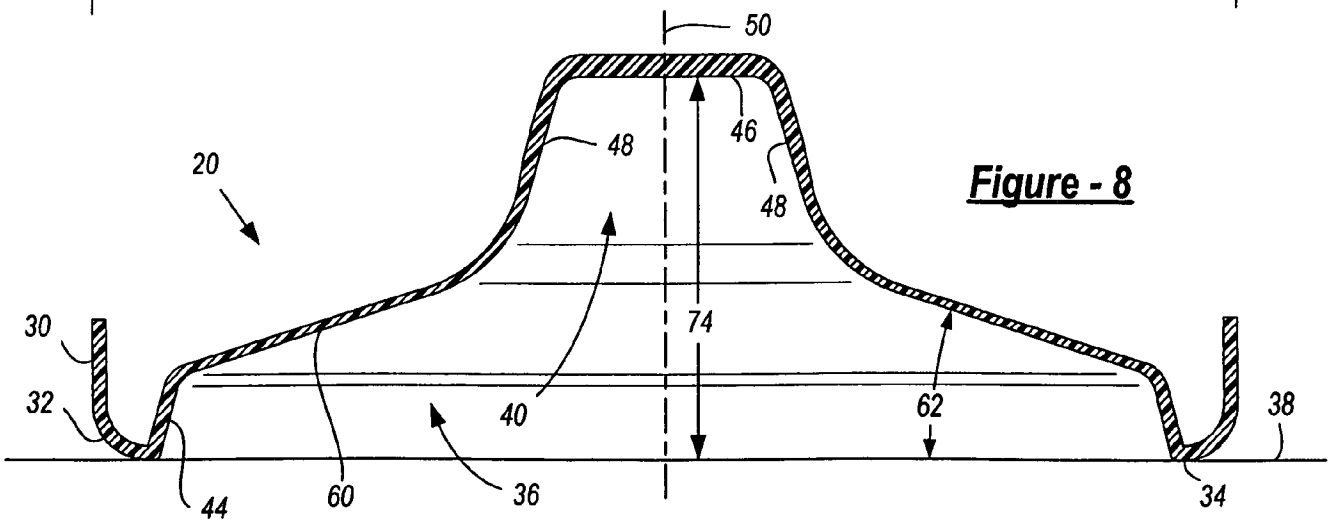
FIG. 8 is a cross-sectional view of the plastic container, similar to FIG. 6, showing the other embodiment.

When initially formed, the central pushup 40 and the inversion ring 42 remain as described above and shown in FIGS. 1, 3, 5, 7, and 10. Accordingly, as molded, a dimension 52 measured between the upper portion 54 of the inversion ring 42 and the support surface 38 is greater than or equal to a dimension 56 measured between the lower portion 58 of the inversion ring 42 and the support surface 38. Upon filling, the central portion 36 of the base 20 and the inversion ring 42 will slightly sag or deflect downward toward the support surface 38 under the temperature and weight of the product. As a result, the dimension 56 becomes almost zero, that is, the lower portion 58 of the inversion ring 42 is practically in contact with the support surface 38. Upon filling, capping, sealing, and cooling of the container 10, as shown in FIGS. 2, 4, 6, 8, and 12, vacuum related forces cause the central pushup 40 and the inversion ring 42 to rise or push upward thereby displacing volume. In this position, the central pushup 40 generally retains its truncated cone shape in cross section with the top surface 46 of the central pushup 40 remaining substantially parallel to the support surface 38. The inversion ring 42 is incorporated into the central portion 36 of the base 20 and virtually disappears, becoming more conical in shape (see FIG. 8). Accordingly, upon capping, sealing, and cooling of the container 10, the central portion 36 of the base 20 exhibits a substantially conical shape having surfaces 60 in cross section that are generally planar and slope upward toward the central longitudinal axis 50 of the container 10, as shown in FIGS. 6 and 8. This conical shape and the generally planar surfaces 60 are defined in part by an angle 62 of approximately 7° to approximately 23°, and more typically between approximately 10° and approximately 17°, relative to a horizontal plane or the support surface 38. As the value of dimension 52 increases and the value of dimension 56 decreases, the potential displacement of volume within container 10 increases. Moreover, while planar surfaces 60 are substantially straight (particularly as illustrated in FIG. 8), those skilled in the art will realize that planar surfaces 60 will often have a somewhat rippled appearance. A typical 2.64-inch (67.06 mm) diameter base container, container 10 with base 20, has an as molded base clearance dimension 72, measured from the top surface 46 to the support surface 38, with a value of approximately 0.500 inch (12.70 mm) to approximately 0.600 inch (15.24 mm) (see FIG. 7). When responding to vacuum related forces, base 20 has an as filled base clearance dimension 74, measured from the top surface 46 to the support surface 38, with a value of approximately 0.650 inch (16.51 mm) to approximately 0.900 inch (22.86 mm) (see FIG. 8). For smaller or larger containers, the value of the as molded base clearance dimension 72 and the value of the as filled base clearance dimension 74 may be proportionally different.

The amount of volume which the central portion 36 of the base 20 displaces is also dependant on the projected surface area of the central portion 36 of the base 20 as compared to the projected total surface area of the base 20. In order to eliminate the necessity of providing vacuum panels or pinch grips in the body portion 18 of the container 10, the central portion 36 of the base 20 requires a projected surface area of approximately 55%, and preferably greater than approximately 70%, of the total projected surface area of the base 20. As illustrated in FIGS. 5 and 7, the relevant projected linear lengths across the base 20 are identified as A, B, $C_{1\ and\ C2}$. The following equation defines the projected total surface area of the base 20 ($PSA_A$):

$$PSA_A=\pi(\tfrac{1}{2}A)^2.$$

Accordingly, for a container having a 2.64-inch (67.06 mm) diameter base, the projected total surface area ($PSA_A$) is 5.474 in.$^2$ (35.32 cm$^2$). The following equation defines the projected surface area of the central portion 36 of the base 20 ($PSA_B$):

$$PSAB=\pi(\tfrac{1}{2}B)^2$$

where $B=A-C_1-C_2$. For a container having a 2.64-inch (67.06 mm) diameter base, the length of the chime 32 ($C_1$ and $C_2$) is generally in the range of approximately 0.030 inches (0.76 mm) to approximately 0.34 inches (8.64 mm). Accordingly, the B dimension is generally in the range of approximately 1.92 inches (48.77 mm) to approximately 2.58 inches (65.53 mm). If, for example, $C_1$ and $C_2$ are equal to 0.120 inch (3.05 mm), the projected surface area for the central portion 36 of the base 20 ($PSA_B$) is approximately 4.524 in.$^2$ (29.19 cm$^2$).

Thus, in this example, the projected surface area of the central portion 36 of the base 20 ($PSA_B$) for a 2.64-inch (67.06 mm) diameter base container is approximately 83% of the projected total surface area of the base 20 ($PSA_A$). The greater the percentage, the greater the amount of vacuum the container 10 can accommodate without unwanted deformation in other areas of the container 10.

Pressure acts in an uniform manner on the interior of a plastic container that is under vacuum. Force, however, will differ based on geometry (i.e., surface area). The following equation defines the pressure in a container having a circular cross section:

$$P = \frac{F}{A}$$

where F represents force in pounds and A represents area in inches squared. As illustrated in FIG. 1, $d_1$ , identifies the diameter of the central portion 36 of the base 20 and $d_2$ identifies the diameter of the body portion 18. Continuing with FIG. 1, I identifies the smooth label panel area of the plastic container 10, the height of the body portion 18, from the bottom of the shoulder region 16 to the top of the chime 32. As set forth above, those skilled in the art know and understand that added geometry (i.e., ribs) in the body portion 18 will have a stiffening effect. The below analysis considers only those portions of the container that do not have such geometry.

According to the above, the following equation defines the pressure associated with the central portion 36 of the base 20 ($P_B$):

$$P_B = \frac{F_1}{A_1}$$

where $F_1$ represents the force exerted on the central portion 36 of the base 20 and $$A_1 = \frac{\pi d_1^2}{4},$$

the area associated with the central portion 36 of the base 20. Similarly, the following equation defines the pressure associated with the body portion 18 ($P_{BP}$):

$$P_{BP} = \frac{F_2}{A_2}$$

where $F_2$ represents the force exerted on the body portion 18 and $A_2=\pi d_2 l$, the area associated with the body portion 18. Thus, the following equation defines a force ratio between the force exerted on the body portion 18 of the container 10 compared to the force exerted on the central portion 36 of the base 20:

$$\frac{F_2}{F_1} = \frac{4d_2 l}{d_1^2}.$$

For optimum performance, the above force ratio should be less than 10, with lower ratio values being most desirable.

As set forth above, the difference in wall thickness between the base 20 and the body portion 18 of the container 10 is also of importance. The wall thickness of the body portion 18 must be large enough to allow the inversion ring 42 to flex properly. As the above force ratio approaches 10, the wall thickness in the base 20 of the container 10 is required to be much less than the wall thickness of the body portion 18. Depending on the geometry of the base 20 and the amount of force required to allow the inversion ring 42 to flex properly, that is, the ease of movement, the wall thickness of the body portion 18 must be at least 15%, on average, greater than the wall thickness of the base 20. Preferably, the wall thickness of the body portion 18 is between two (2) to three (3) times greater than the wall thickness 66 of the lower portion 58 of inversion ring 42. A greater difference is required if the container must withstand higher forces either from the force required to initially cause the inversion ring 42 to flex or to accommodate additional applied forces once the base 20 movement has been completed.

The following table is illustrative of numerous containers that exhibit the above-described principles and concepts.

| | Container Size | | | | |
|---|---|---|---|---|---|
| | 500 ml | 500 ml | 16 fl. oz. | 16 fl. oz. | 20 fl. oz. |
| $D_1$ (in.) | 2.400 | 2.422 | 2.386 | 2.421 | 2.509 |
| $D_2$ (in.) | 2.640 | 2.640 | 2.628 | 2.579 | 2.758 |
| I (in.) | 2.376 | 2.819 | 3.287 | 3.125 | 2.901 |
| $A_1$ (in.$^2$) | 4.5 | 4.6 | 4.4 | 4.6 | 4.9 |
| $A_2$ (in.$^2$) | 19.7 | 23.4 | 27.1 | 25.3 | 25.1 |
| Force Ratio | 4.36 | 5.07 | 6.16 | 5.50 | 5.08 |
| Body Portion (18) Avg. Wall Thickness (in.) | 0.028 | 0.028 | 0.029 | 0.026 | 0.029 |
| Contract Ring (34) Avg. Wall Thickness (68) (in.) | 0.012 | 0.014 | 0.015 | 0.015 | 0.014 |
| Inversion Ring (42) Avg. Wall Thickness (66) (in.) | 0.011 | 0.012 | 0.012 | 0.013 | 0.012 |
| Molded Base Clearance (72) (in.) | 0.576 | 0.535 | 0.573 | 0.534 | 0.550 |
| Filled Base Clearance (74) (in.) | 0.844 | 0.799 | 0.776 | 0.756 | 0.840 |
| Weight (g.) | 36 | 36 | 36 | 36 | 39 |

In all of the above illustrative examples, the bases of the container function as the major deforming mechanism of the container. The body portion (18) wall thickness to the base (20) wall thickness comparison is dependent in part on the force ratios and container geometry. One can undertake a similar analysis with similar results for containers having non-circular cross sections (i.e., rectangular or square).

Accordingly, the thin, flexible, curved, generally "S" shaped geometry of the inversion ring 42 of the base 20 of the container 10 allows for greater volume displacement versus containers having a substantially flat base. FIGS. 1-6 illustrate base 20 having a flared-out geometry as a means to increase the projected area of the central portion 36, and thus increase its ability to respond to vacuum related forces. The flared-out geometry further enhances the response in that the flared-out geometry deforms slightly inward, adding volume displacement capacity. However, the inventors have discovered that the flared-out geometry is not always necessary. FIGS. 7, 8, 10, and 12 illustrate the preferred embodiment of the present invention without the flared-out geometry. That is, chime 32 merges directly with sidewall 30, thereby giving the container 10 a more conventional visual appearance. Similar reference numerals will describe similar components between the various embodiments.

The inventors have determined that the "S" geometry of inversion ring 42 may perform better if skewed (see FIG. 7). That is, if the upper portion 54 of the inversion ring 42 features in cross section a curve having a radius 76 that is significantly smaller than a radius 78 of an adjacent curve associated with the lower portion 58. That is, where radius 76 has a value that is at most generally 35% of that of radius 78. This skewed "S" geometry tends to optimize the degree of volume displacement while retaining a degree of response ease. This skewed "S" geometry provides significant volume displacement while minimizing the amount of vacuum related forces necessary to cause movement of the inversion ring 42. Accordingly, when container 10, includes a radius 76 that is significantly smaller than radius 78 and is under vacuum related forces, planar surfaces 60 can often achieve a generally larger angle 62 than what otherwise is likely. For example, in general, for the container 10 having a 2.64-inch (67.06 mm) diameter base, radius 76 is approximately 0.078 inch (1.98 mm), radius 78 is approximately 0.460 inch (11.68 mm), and, under vacuum related forces, angle 62 is approximately 16° to 17°. Those skilled in the art know and understand that other values for radius 76, radius 78, and angle 62 are feasible, particularly for containers having a different diameter base size.

Figure 9:
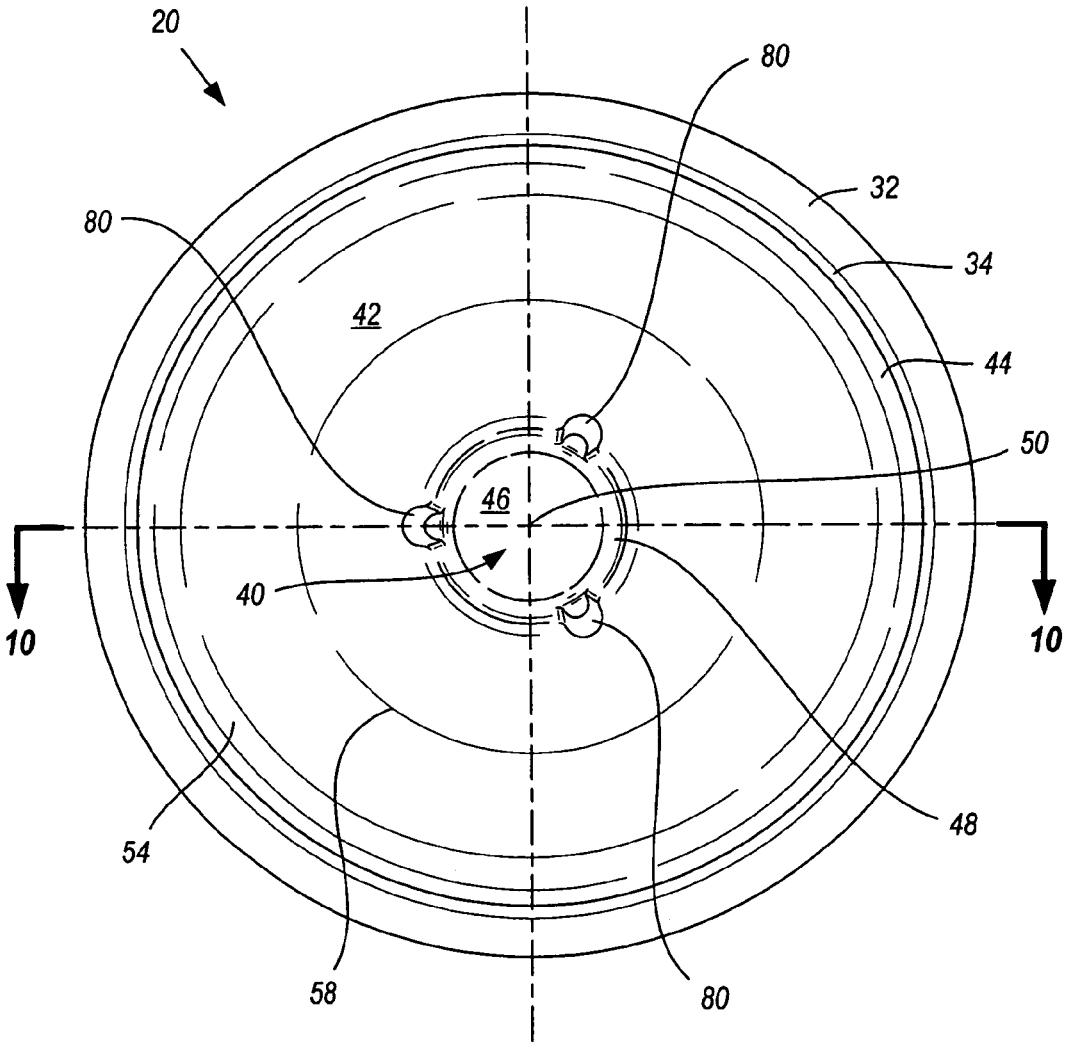
FIG. 9 is a bottom view of an additional embodiment of the plastic container, the container as molded and empty.
Figure 10:
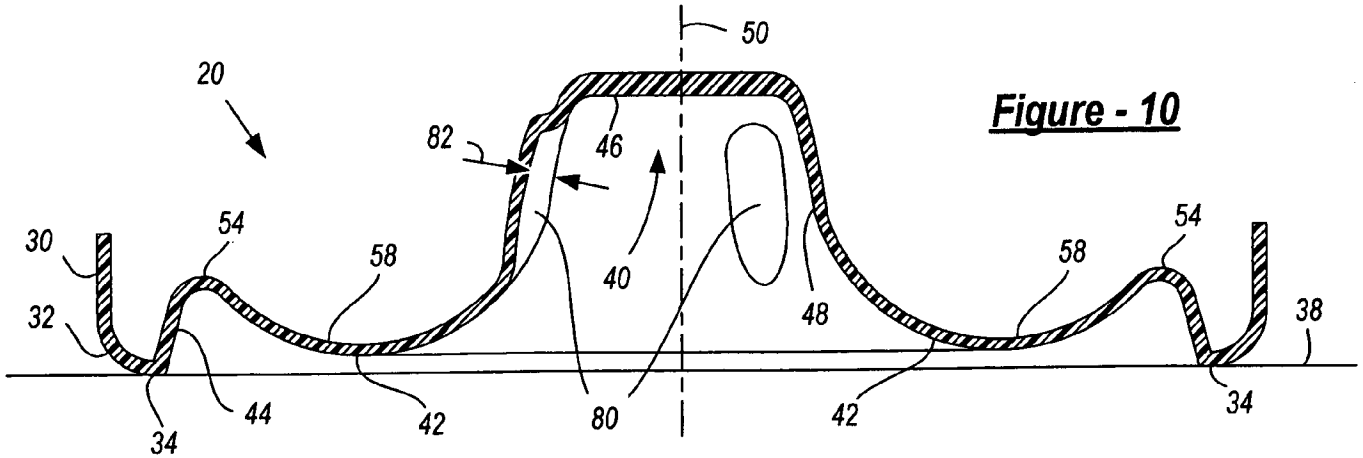
FIG. 10 is a cross-sectional view of the plastic container, taken generally along line 10-10 of FIG. 9.
Figure 12:
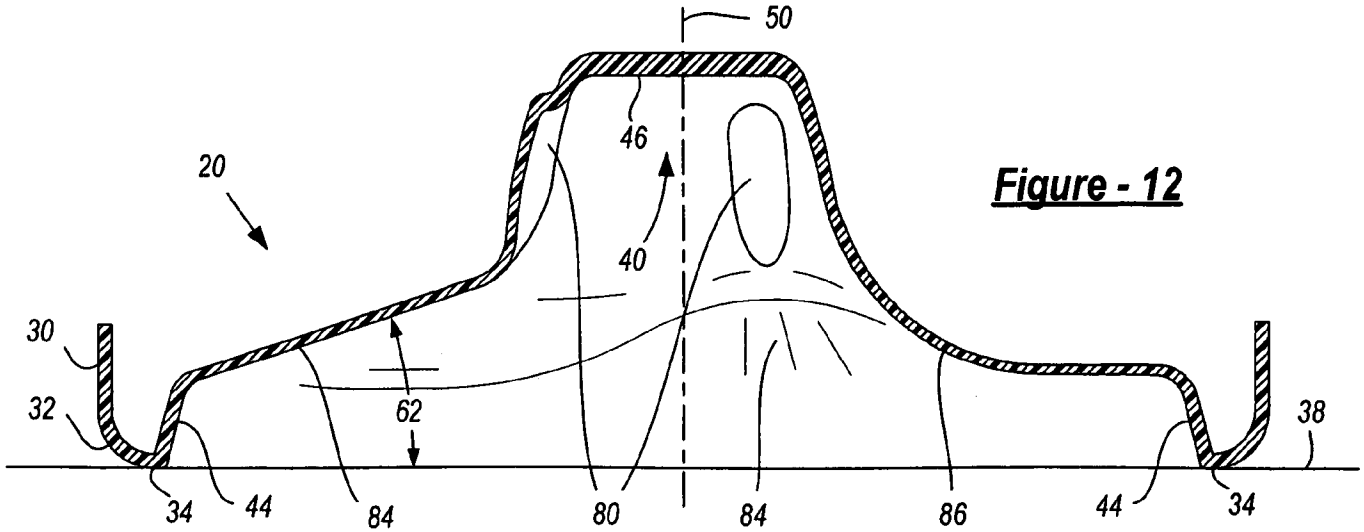
FIG. 12 is a cross-sectional view of the plastic container, taken generally along line 12-12 of FIG. 11.

While not always necessary, the inventors have further refined the preferred embodiment of base 20 by adding three grooves 80 substantially parallel to side surfaces 48. As illustrated in FIGS. 9 and 10, grooves 80 are equally spaced about central pushup 40. Grooves 80 have a substantially semicircular configuration, in cross section, with surfaces that smoothly blend with adjacent side surfaces 48. Generally, for container 10 having a 2.64-inch (67.06 mm) diameter base, grooves 80 have a depth 82, relative to side surfaces 48, of approximately 0.118 inch (3.00 mm), typical for containers having a nominal capacity between 16 fl. oz and 20 fl. oz. The inventors anticipate, as an alternative to more traditional approaches, that the central pushup 40 having grooves 80 may be suitable for engaging a retractable spindle (not illustrated) for rotating container 10 about central longitudinal axis 50 during a label attachment process. While three (3) grooves 80 are shown, and is the preferred configuration, those skilled in the art will know and understand that some other number of grooves 80, i.e., 2, 4, 5, or 6, may be appropriate for some container configurations.

Figure 11:
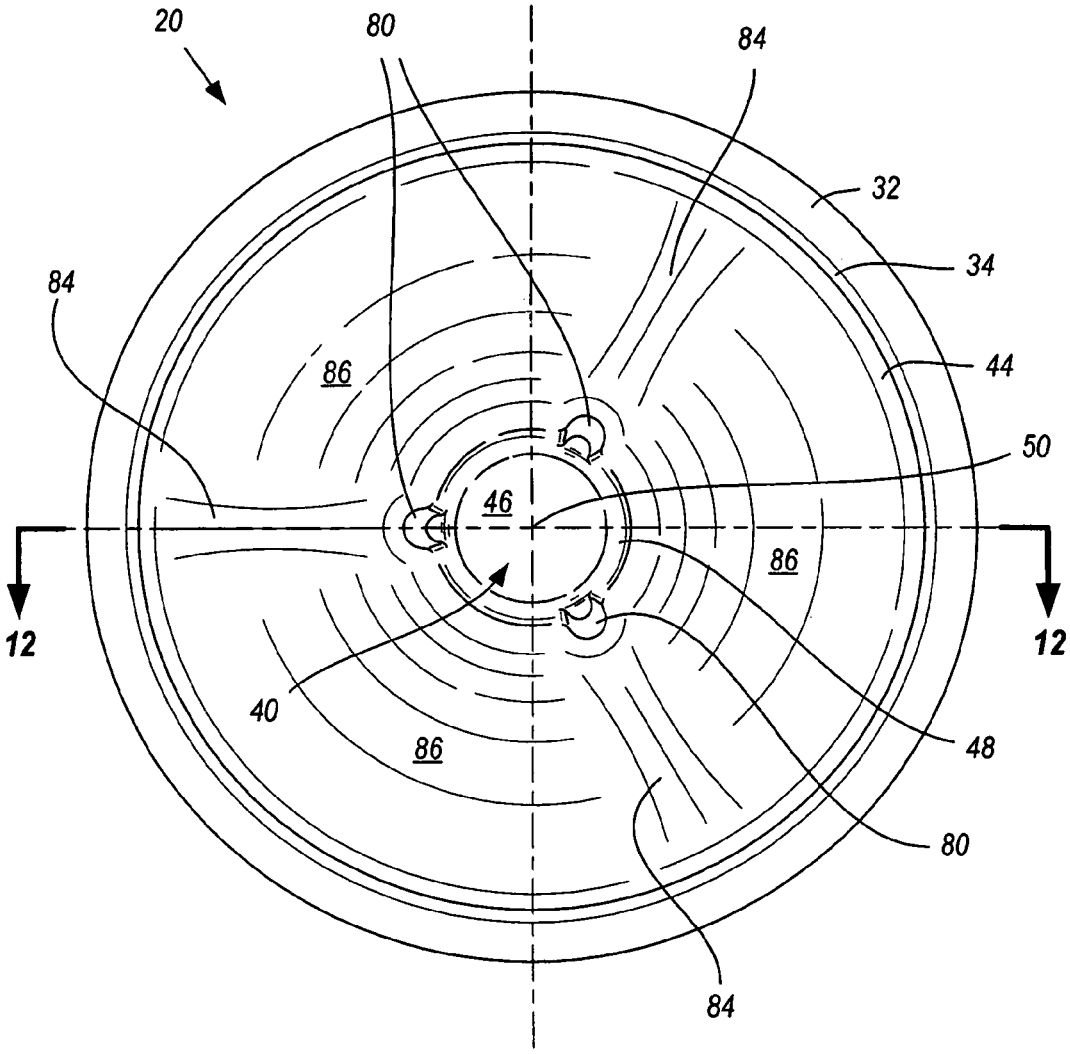
FIG. 11 is a bottom view of the embodiment of the plastic container shown in FIG. 9, the plastic container being filled and sealed.

As base 20, with a relative wall thickness relationship as described above, responds to vacuum related forces, grooves 80 may help facilitate a progressive and uniform movement of the inversion ring 42. Without grooves 80, particularly if the wall thickness 66 is not uniform or consistent about the central longitudinal axis 50, the inversion ring 42, responding to vacuum related forces, may not move uniformly or may move in an inconsistent, twisted, or lopsided manner. Accordingly, with grooves 80, radial portions 84 form (at least initially during movement) within the inversion ring 42 and extend generally adjacent to each groove 80 in a radial direction from the central longitudinal axis 50 (see FIG. 11) becoming, in cross section, a substantially straight surface having angle 62 (see FIG. 12). Said differently, when one views base 20 as illustrated in FIG. 11, the formation of radial portions 84 appear as valley-like indentations within the inversion ring 42. Consequently, a second portion 86 of the inversion ring 42 between any two adjacent radial portions 84 retains (at least initially during movement) a somewhat rounded partially inverted shape (see FIG. 12). In practice, the preferred embodiment illustrated in FIGS. 9 and 10 often assumes the shape configuration illustrated in FIGS. 11 and 12 as its final shape configuration. However, with additional vacuum related forces applied, the second portion 86 eventually straightens forming the generally conical shape having planar surfaces 60 sloping toward the central longitudinal axis 50 at angle 62 similar to that illustrated in FIG. 8. Again, those skilled in the art know and understand that the planar surfaces 60 will likely become somewhat rippled in appearance. The exact nature of the planar surfaces 60 will depend on a number of other variables, for example, specific wall thickness relationships within the base 20 and the sidewalls 30, specific container 10 proportions (i.e., diameter, height, capacity), specific hot-fill process conditions and others.

While the above description constitutes the preferred embodiment of the present invention, it will be appreciated that the invention is susceptible to modification, variation and change without departing from the proper scope and fair meaning of the accompanying claims.

What is claimed is:

1. A plastic container comprising:

an upper portion having a mouth defining an opening into said container, a neck extending from said upper portion, a body portion extending from said neck to a base, said base closing off an end of said container; said upper portion, said neck, said body portion and said base cooperating to define a receptacle chamber within said container into which product can be filled; said base including a chime extending from said body portion to a contact ring which defines a surface upon which said container is supported, said base further including a central portion defined in at least part by a pushup having a generally truncated cone shape in cross section located on a longitudinal axis of said container, and an inversion ring having an upper portion, a lower portion and a generally S shaped geometry in cross section, and circumscribing said pushup; said truncated cone having an overall general diameter that is at most 30% of an overall general diameter of said base and a top surface generally parallel to a support surface; said lower portion of said inversion ring has an average wall thickness and said contact ring has an average wall thickness, said contact ring average wall thickness being at least equal to said lower portion average wall thickness.

2. The container of claim 1 wherein said body portion includes a substantially smooth sidewall.

3. The container of claim 1 wherein said pushup includes a side surface having a plurality of grooves formed therein.

4. The container of claim 1 wherein said inversion ring has a wall thickness between approximately 0.008 inch (0.20 mm) to approximately 0.025 inch (0.64 mm).

5. The container of claim 1 wherein said upper portion of said inversion ring includes in part a curve in cross section having a first radius and said lower portion includes in part a second curve in cross section having a second radius; said first radius has a value that is at most 35% of a value of said second radius.

6. The container of claim 1 wherein between said inversion ring and said contact ring is an upstanding circumferential wall having an angle relative to said longitudinal axis between zero and 20 degrees.

7. The container of claim 6 wherein said upstanding circumferential wall in cross section has a length between approximately 0.030 inch (0.76 mm) to approximately 0.325 inch (8.26 mm).

8. The container of claim 1 wherein a first distance between said upper portion of said inversion ring and said support surface is greater than a second distance between said lower portion and said support surface.

9. The container of claim 1 wherein said body portion has an average wall thickness and said base has an average wall thickness, said body portion average wall thickness being at least fifteen percent (15%) greater than said base average wall thickness.

10. The container of claim 1 wherein said body portion has an average wall thickness and said lower portion of said inversion ring has an average wall thickness, said body portion average wall thickness being at least two (2) times greater than said lower portion average wall thickness.

11. The container of claim 1 wherein said contact ring average wall thickness is at least ten percent (10) greater than said lower portion average wall thickness.

12. A plastic container filled with a liquid at an elevated temperature, sealed with a closure, and cooled thereby establishing a vacuum within said container, said container comprising:

an upper portion having a mouth defining an opening into said container and a finish for attaching the closure, a neck extending from said upper portion, a body portion extending from said neck to a base, said base closing off an end of said container; said upper portion, said neck, said body portion and said base cooperating to define a receptacle chamber within said container into which the liquid can be filed at the elevated temperature; said base adapted for vacuum absorption and including a chime extending from said body portion to a contact ring which defines a surface upon which said container is supported, said base further including a central portion defined in at least part by a pushup having a generally truncated cone shape in cross section located on a longitudinal axis of said container, and an inversion ring circumscribing said pushup; said truncated cone having an overall general diameter that is at most 30% of an overall general diameter of said base and a top surface generally parallel to a support surface; said pushup and said inversion ring being moveable to accommodate vacuum related forces generated within said container; said inversion ring defining an inwardly domed shaped portion having a surface that is at least in part generally sloped toward said longitudinal axis of said container at an angle in a range of approximately 16° to approximately 23° relative to said support surface; said inversion ring having a generally S shaped geometry in cross section after removal of the liquid from said container.

13. The container of claim 12 wherein the temperature of the liquid is between approximately 155° F. to 205° F. (approximately 68°C. to 96°C.).

14. The container of claim 12 wherein said pushup includes a side surface having a plurality of grooves formed therein.

15. The container of claim 14 wherein said inwardly domed shaped portion of said inversion ring has a plurality of valley-like indentions formed therein and each of said plurality of valley-like indentions extend adjacent to a corresponding one of said plurality of grooves in a radial direction.

16. The container of claim 12 wherein said angle is in a range of approximately 16° to approximately 17° relative to said support surface.

17. A stretch-molded heat-set plastic container formed in a mold cavity having a temperature of approximately 250° F. to 350° F. (approximately 121° C. to 177° C.), said container comprising:

an upper portion having a mouth defining an opening into said container, a neck extending from said upper portion, a body portion extending from said neck to a base, said base closing off an end of said container; said upper portion, said neck, said body portion and said base cooperating to define a receptacle chamber within said container into which product can be filled; said base including a chime extending from said body portion to a contact ring which defines a surface upon which said container is supported, said base further including central portion defined in at least part by a pushup having a generally truncated cone shape in cross section located on a longitudinal axis of said container, and an inversion ring having an upper portion, a lower portion and a generally S shaped geometry in cross section and circumscribing said pushup; said truncated cone having an overall general diameter that is at most 30% of an overall general diameter of said base and a top surface generally parallel to a support surface; said container generally having a biaxially oriented molecular structure; said body portion has an average wall thickness and said lower portion of said inversion ring has an average wall thickness, said body portion average wall thickness being at least two (2) times greater than said lower portion average wall thickness.

18. The container of claim 17 wherein said plastic is a polyester polymer material.

19. The container of claim 18 wherein said polyester polymer material is generally a polyethylene terephthalate.

20. A plastic container comprising:

an upper portion having a mouth defining an opening into said container, a neck extending from said upper portion, a body portion extending from said neck to a base, said base closing off an end of said container; said upper portion, said neck, said body portion and said base cooperating to define a receptacle chamber within said container into which product can be filled; said base including a chime extending from said body portion to a contact ring which defines a surface upon which said container is supported, said base further including a central portion defined in at least part by a pushup having a generally truncated cone shape in cross section located on a longitudinal axis of said container, and an inversion ring having an upper portion, a lower portion and a generally S shaped geometry in cross section, and circumscribing said pushup; said truncated cone having an overall general diameter that is at most 30% of an overall general diameter of said base and a top surface generally parallel to a support surface; said inversion ring upper portion includes in part a curve in cross section having a first radius and said inversion ring lower portion includes in part a second curve in cross section having a second radius; said first radius has a value that is at most 35% of a value of said second radius.

* * * * *

UNITED STATES PATENT AND TRADEMARK OFFICE

CERTIFICATE OF CORRECTION

PATENT NO. : 7,451,886 B2
APPLICATION NO. : 11/151676
DATED : June 14, 2005
INVENTOR(S) : G. David Lisch et al.

It is certified that error appears in the above-identified patent and that said Letters Patent is hereby corrected as shown below:

Column 1, line 4, insert --CROSS--REFERENCE TO RELATED APPLICATIONS--.

Column 8, line 46, "$C_{1 \text{ and } C2}$" should be --$C_1$ and $C_2$--.

Column 8, line 57, "PSAB" should be --$PSA_B$--.

Column 13, line 24, claim 11, "(10)" should be --(10%)--.

Signed and Sealed this

Fifth Day of May, 2009

JOHN DOLL
*Acting Director of the United States Patent and Trademark Office*

UNITED STATES PATENT AND TRADEMARK OFFICE

CERTIFICATE OF CORRECTION

PATENT NO. : 7,451,886 B2
APPLICATION NO. : 11/151676
DATED : November 18, 2008
INVENTOR(S) : G. David Lisch et al.

It is certified that error appears in the above-identified patent and that said Letters Patent is hereby corrected as shown below:

Column 1, line 4, insert --CROSS--REFERENCE TO RELATED APPLICATIONS--.

Column 8, line 46, "$C_{1 \text{ and } C2}$" should be --$C_1$ and $C_2$--.

Column 8, line 57, "PSAB" should be --$PSA_B$--.

Column 13, line 24, claim 11, "(10)" should be --(10%)--.

This certificate supersedes the Certificate of Correction issued May 5, 2009.

Signed and Sealed this

Twenty-sixth Day of May, 2009

John Doll

JOHN DOLL
*Acting Director of the United States Patent and Trademark Office*

UNITED STATES PATENT AND TRADEMARK OFFICE

CERTIFICATE OF CORRECTION

PATENT NO. : 7,451,886 B2
APPLICATION NO. : 11/151676
DATED : November 18, 2008
INVENTOR(S) : G. David Lisch et al.

It is certified that error appears in the above-identified patent and that said Letters Patent is hereby corrected as shown below:

Column 1, line 4, insert --CROSS-REFERENCE TO RELATED APPLICATIONS--.

Column 8, line 46, "$C_{1 \text{ and } C2}$" should be --$C_1$ and $C_2$--.

Column 8, line 57, "PSAB" should be --$PSA_B$--.

Column 13, line 24, claim 11, "(10)" should be --(10%)--.

This certificate supersedes the Certificates of Correction issued May 5, 2009 and May 26, 2009.

Signed and Sealed this

Twenty-third Day of June, 2009

John Doll

JOHN DOLL
*Acting Director of the United States Patent and Trademark Office*